US005472462A

United States Patent [19]

Pischinger et al.

[11] Patent Number: 5,472,462

[45] Date of Patent: Dec. 5, 1995

[54] FILTER ARRANGEMENT FOR REMOVAL OF SOOT PARTICLES FROM THE EXHAUST GASES OF AN INTERNAL COMBUSTION ENGINE

[75] Inventors: Franz Pischinger, Im Erkfeld; Gerhard Lepperhoff, Eschweiler; Georg Hüthwohl; Rolf Backes, both of Aachen, all of Germany

[73] Assignee: Fev Motorentechnik GmbH & Co. KG, Aachen, Germany

[21] Appl. No.: 142,434

[22] PCT Filed: Mar. 11, 1993

[86] PCT No.: PCT/EP93/00553

§ 371 Date: Jan. 6, 1994

§ 102(e) Date: Jan. 6, 1994

[87] PCT Pub. No.: WO93/19288

PCT Pub. Date: Sep. 30, 1993

[30] Foreign Application Priority Data

Mar. 21, 1992 [DE] Germany ..... 42 09 213.2

[51] Int. Cl.[6] ..... B01D 46/00

[52] U.S. Cl. ..... 55/282; 55/523; 55/DIG. 10; 55/DIG. 30; 60/303

[58] Field of Search ..... 55/267, 282, 466, 55/523, DIG. 10, DIG. 30; 60/303, 311; 95/283, 278

[56] References Cited

U.S. PATENT DOCUMENTS

| | | | |
|---|---|---|---|
| 4,505,726 | 3/1985 | Takeuchi et al. | 55/DIG. 10 |
| 4,512,786 | 4/1985 | Sakurai et al. . | |
| 4,519,820 | 5/1985 | Oyobe et al. | 55/466 |
| 4,872,889 | 10/1989 | Lepperhoff et al. . | |
| 4,897,096 | 1/1990 | Pischinger et al. | 55/466 |
| 4,948,403 | 8/1990 | Lepperhoff et al. . | |
| 4,975,009 | 12/1990 | Kaser et al. | 60/303 |
| 5,144,798 | 9/1992 | Kojima et al. | 60/303 |

FOREIGN PATENT DOCUMENTS

| | | | |
|---|---|---|---|
| 0286932A3 | 10/1988 | European Pat. Off. . | |
| 0359031A1 | 3/1990 | European Pat. Off. . | |
| 3803100A1 | 8/1989 | Germany . | |
| 3838589 | 12/1989 | Germany | 55/DIG. 10 |
| 64-69711 | 3/1989 | Japan | 60/303 |

*Primary Examiner*—C. Scott Bushey
*Attorney, Agent, or Firm*—Spencer, Frank & Schneider

[57] ABSTRACT

A filter arrangement for removal of soot particles from the exhaust gases of an internal combustion engine, including a current supply and a filter body. The filter body is composed of a porous filter material. The filter body has a plurality of filter ducts arranged in a honey-comb pattern. Each filter duct has an inlet opening for the intake of the exhaust gases. The filter arrangement further includes a resistance heating element arranged in a region of each inlet opening and having a series of loops each projecting into the filter ducts. The resistance heating element further has a lead-in line and a lead-out line connected to the current supply. A wall of a respective filter duct and a respective heating element loop are form lockingly connected together.

5 Claims, 3 Drawing Sheets

FILTER ARRANGEMENT FOR REMOVAL OF SOOT PARTICLES FROM THE EXHAUST GASES OF AN INTERNAL COMBUSTION ENGINE

BACKGROUND OF THE INVENTION

The invention relates to a filter arrangement for removing soot particles from the exhaust gases of an internal combustion engine, particularly a diesel engine, having at least one filter body made of a porous filter material and comprising filter ducts arranged in a honey-comb configuration. In the region of the inlet openings of the filter ducts, which are open toward the gas intake side, an electric resistance heating element is arranged which is associated with a plurality of inlet openings. This heating element enters into the filter ducts in the form of loops and is connected with a current supply by way of a lead-in line and a lead-out line.

Follow-up treatment systems for exhaust gas to reduce particle emission, particularly in diesel engines, are known. Such systems usually consist of filter systems that retain and collect the particles present in the exhaust gas. The soot particles retained in the filter cause an increase in the flow resistance in the exhaust system, resulting in an increase in the exhaust gas back pressure of the engine. This leads to increased fuel consumption and, in the extreme case, to engine stoppage. Thus, it is necessary to remove the soot particles which are deposited in the filter. This may be accomplished, for example, by oxidation at high temperatures.

So-called honey-comb filters made of a porous ceramic material have proved to be expedient as filter bodies for retaining soot particles. These honey-comb filters are configured of a plurality of parallel filter ducts which are closed alternately on the gas intake side and on the gas discharge side, so that the exhaust gases flow through the porous filter walls and thereby deposit the soot particles on the walls of the filter ducts.

To regenerate the filter, it is possible, for example, to increase the exhaust gas temperature so much that the ignition temperature for soot particles deposited on the walls of the filter ducts is reached and the particles incinerate. The temperatures required for this process are not reached as often as required, at least not in diesel engines for automobiles and thus regeneration is not ensured. Moreover, additional engine measures for increasing the exhaust temperature may be connected with a significant increase in fuel consumption. The use of additional energy, for example, by additional burners, to increase the exhaust gas temperature, requires high power and thus leads to an increase in the vehicle's energy consumption.

Energy efficient regeneration may be obtained, if the soot layer deposited at the filter body in the inlet region of the filter ducts is promptly ignited by a short-term energy supply. The release of energy during the combustion of soot which then follows, may lead to self-supporting soot combustion, since the released heat is greater than the dissipated heat.

To accomplish this, resistance heating elements, each provided with a lead-in line and a lead-out line, which provide heating zones for adjacent end-face regions, are arranged at the intake side of the end face of the filter body. Due to the division of the intake side of the end face of the filter body into a plurality of heating zones, it is possible to adjust the resistance heating elements required for this purpose with respect to the electrical energy required to produce the ignition temperature to the performance of the generator provided in the vehicle. The size of the heating zone charged by the respective resistance heating element is determined by the electrical resistance required by the heating element for the release of heat, with a given wire diameter and a given wire material, as well as the power of the available current supply, particularly, of the available generator in the vehicle. The division of the end face of the filter body into a corresponding number of heating zones makes it possible to heat practically all filter ducts in the region of their inlet openings despite the restricted availability of electrical power. This occurs in that the individual resistance heating elements are successively switched on and off again by way of a switching arrangement, so that, in a corresponding cycle, the soot deposits in the filter ducts of each heating zone are continuously incinerated.

The resistance heating elements are configured of at least one wire, which is curved in a meander pattern and whose loops are each plugged into an inlet opening of the filter duct.

The free ends of the meander are each connected to a lead-in line or a lead-out line which is spaced from and guided over the end face of the filter body. The advantage of this type of configuration is that due to the plurality of heating wires, which extend parallel to one another, and the lead-in line and lead-out line, respectively, extending transversely thereto in the end region a stable heating element is formed which permits, reliable positioning of the heating wires at their free ends.

However, due to vibrations and thermal expansion, it is possible for the meanders to move out of the ducts and thus dependable durability of the system is no longer ensured. Additional supports and/or cover disks such as described in DE-OS (Unexamined Published German Patent Application) 3,712,333 have the disadvantage of higher manufacturing costs.

SUMMARY OF THE INVENTION

It is the object of the invention to reliably prevent a moving away of the heating loops without additional supports and at low manufacturing costs.

According to the invention, a filter arrangement of the type described above is provided in which the surface of the filter ducts and the heating elements, which enter into the filter ducts in the form of loops, are configured in such a way that the resistance against the outward movement of the heating loops out of the filter duct is at least as great as the resistance against the push of the heating loops into the filter duct. The heating loops entering into the filter duct are preferably connected to the walls of the filter ducts in a form-locking manner (i.e., because of their form, the respective loops and ducts are locked relative to one another), and it may also be advantageous for the cross-section of the filter ducts to be constricted at the intake side.

According to a further embodiment of the invention, the flanks of the heating loops are fixed by means of grooves in the filter duct and by corresponding protuberances of the heating loops in the region of their flanks. Provision may also be made for the heating loops to be fixed by means of grooves in the region of the end face of the filter and by corresponding protuberances in the heating loops in the region of their flanks.

A further advantageous configuration provides that the heating loops are barbed to impede the outward movement of the heating loops, and these barbs may be produced by bending the heating wire correspondingly. It may also be advantageous for the roughness of the heating wire and/or of the filter material to be such that an outward movement of the heating loops is impeded.

A further preferred embodiment of the invention provides for the filter material and the heating loops to be bonded in a form-locking manner by heating the heat conductor to the melting temperature of the ceramic material of the filter body.

BRIEF DESCRIPTION OF THE DRAWINGS

The embodiments of the invention are further elucidated by way of the drawings in which.

DETAILED DESCRIPTION OF A PREFERRED EMBODIMENT

Figure 1:
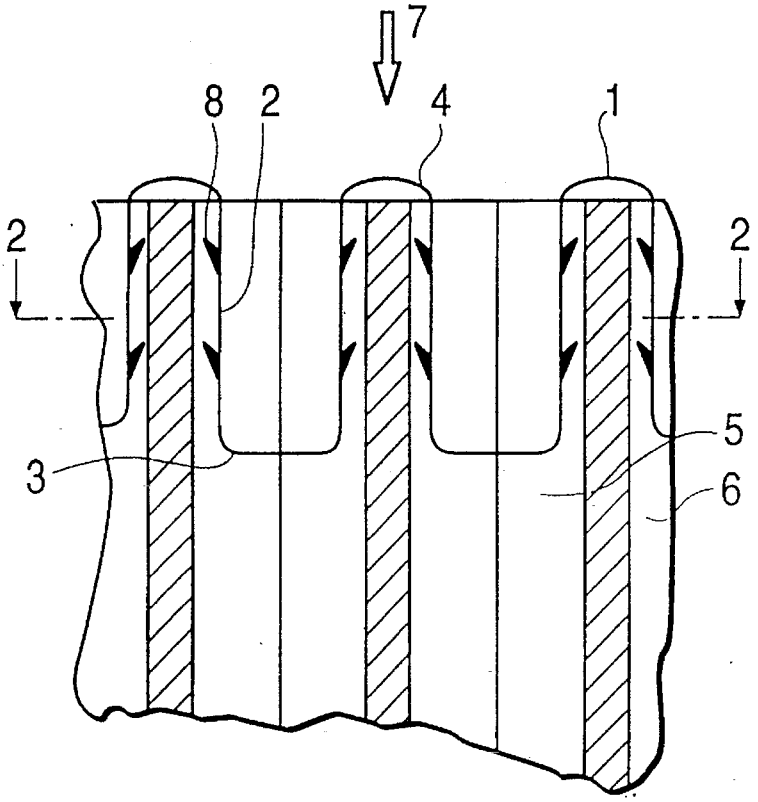
FIG. 1 is a partial longitudinal sectional view and enlarged illustration of a first embodiment of the invention.
Figure 2:
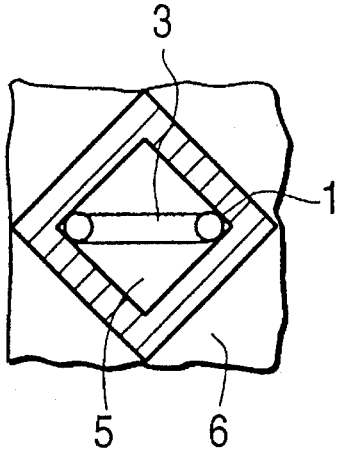
FIG. 2 is a cross sectional view along line 2—2 of FIG. 1.

As shown in FIG. 1, the resistance heating element of a filter arrangement according to the invention comprises a heat conductor 1 bent in a meander pattern, whose flanks 2 enter into the inlet opening of filter ducts 5 of a filter body 6 which is configured as a honey-comb filter. The flanks 2 are connected by means of transverse connectors 3, 4 on the end face of the filter and in the duct. The stream of exhaust gas passes through the filter ducts 5 in the direction of the arrow 7.

According to the invention, the heat conductor is configured in such a way that, during thermal expansion of the loops or during vibrations, no force acting on the end face of the filter can be generated on the filter wall. To this end, barbs 8 are incorporated into the flanks 2 of the heat conductor 1. The result is that during the expansion of the heat conductor 1 due to electric heating, the heat conductor 1 is able to move into the filter duct 5 in the direction of the exhaust gas stream 7. During the subsequent cooling, the length of the heat conductor 1 contracts, and due to the barb 8, the upper conductor region is pulled into the wall of the filter duct 5, such that an outward movement of the heat conductor 1 is prevented.

Figure 3:
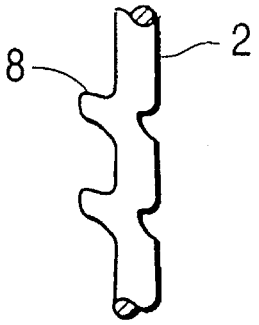
FIG. 3 is an enlarged side view of a portion of a heat conductor.

The barb 8 may be incorporated into the wire material, for example, according to the illustration in FIG. 3, by upsetting or knurling. It is also possible for micro-scales to be incorporated by means of special surface machining.

Figure 4B:
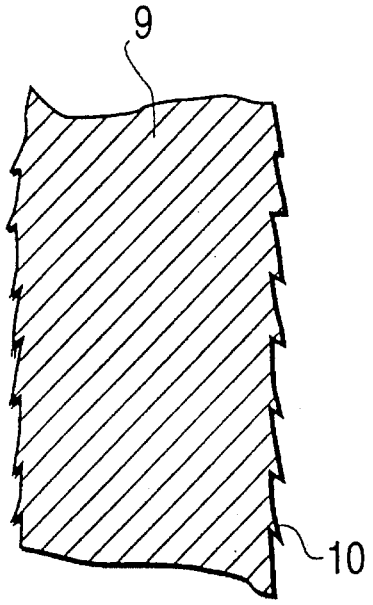
FIG. 4A and 4B are an enlarged illustration of a partial sectional view of the filter arrangement and a side view of a portion of a heat conductor.
Figure 4A:
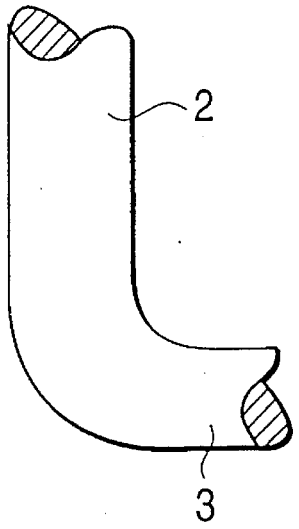

As FIG. 4A and 4B show, it is possible to exclusively or additionally incorporate a micro-scale structure 10 into the ceramic material 9 of the filter duct 5. This may be accomplished by configuring the surface of the opening section of the extruding machine in a special manner. It is also possible to produce the micro-scales by means of special particles which are added to the ceramic substance during the extrusion, and which are washed away or melted away subsequent to the extrusion. During extrusion, these added particles orient themselves on the surface in the direction of the extrusion and thus produce the micro-scales.

In the region of flank 2 of the heat conductor 1, it is possible to produce friction pairing by treating the surfaces of the heat conductor or the filter wall so as to provide greater friction coefficient in the direction of the filter end face than in the direction of insertion. The friction resistance of the filter material in this case is influenced, for example, by special surface treatment of the extrusion tool. The friction resistance of the wire material is adjusted by attaching barbs or corresponding surface treatment (for example, knurling).

It is also possible to heat the wire, after mounting in the filter duct, to a temperature in the melting range of the ceramic material. In this case, the ceramic wall in its contact region with the heat conductor is matched to the shape of the latter, such that, in the region of the barbs, form-locking bonds are produced and the meander is fastened.

Figure 5:
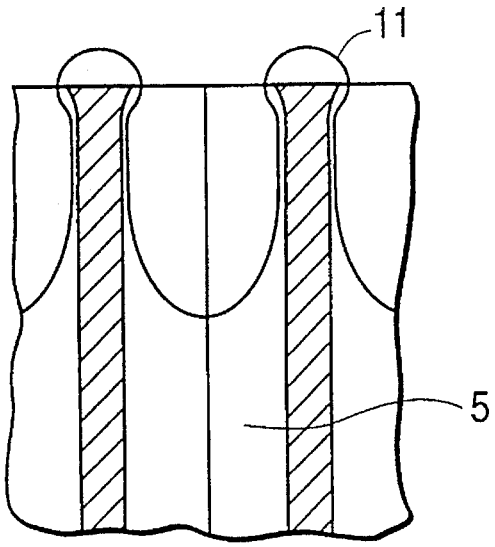
FIGS. 5–7 are partial longitudinal sectional views of further embodiments of the invention.

As FIG. 5 shows, the cross-section of the duct of the filter intake ducts 5 is constricted on the intake side by upsetting the ceramic material prior to firing. The shape of the heat conductor 11 matches the shape of the filter wall. The constriction of the duct in the region of the end face of the filter may, for example, be accomplished by means of plastic deformation of the extruded filter blank prior to the actual firing process. The heat conductor 11 has a form which, in the region of the flank, corresponds to the constriction, which results in an additional force to counteract the outward movement of the heat conductor 11.

Figure 6:
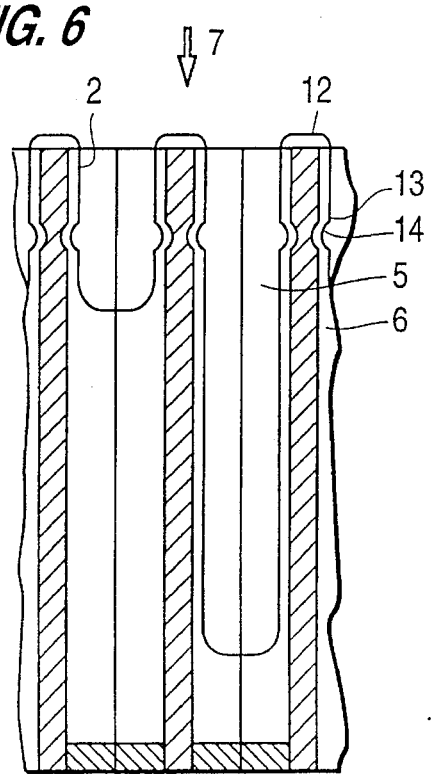

In the embodiment according to FIG. 6, the flank 2 of the heat conductor 12 is additionally incorporated into the wall of the filter duct 5 by means of heating or vibration.

A projection 13 is added to the meander in the region of the loop on the side of the filter inlet. The projection 13 of flank 2 is disposed in a recess 14 of the duct wall. An outward movement of the meander is thus prevented.

Figure 7:
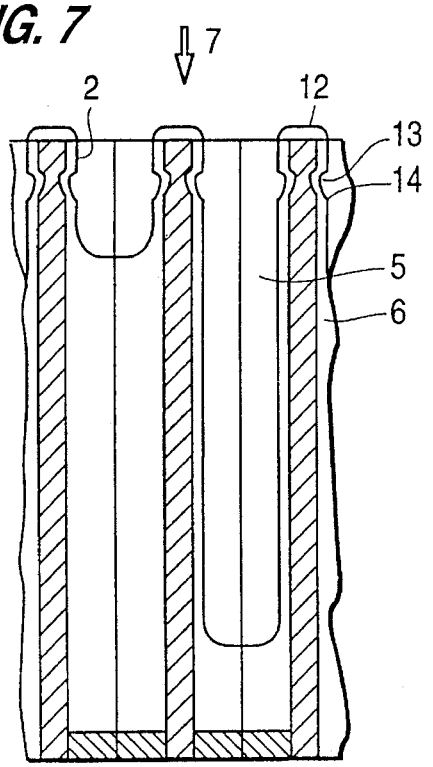

In the embodiment shown in FIG. 7, the projection 13 of the flank 2 is bent in such a way that the resistance to an outward movement of the heating loop out of the filter duct 5 is greater than the resistance against the inward push of the heating loop into the filter duct 5. This advantageously results in an especially secure arrest of the heating loop.

We claim:

1. A filter arrangement for removal of soot particles from the exhaust gases of an internal combustion engine, comprising:

a filter body comprising a porous filter material and having a plurality of filter ducts arranged in a honeycomb pattern, each filter duct having an inlet opening for the intake of the exhaust gases;

a resistance heating element arranged in a region of each inlet opening and having a series of loops, each loop projecting into a respective filter duct, said resistance heating element further having a lead-in line and a lead-out line connection to a current supply; and connecting means for form lockingly connecting a wall of a respective filter duct and a respective heating element loop together, said connecting means comprising a constriction in a cross section of a respective filter duct in a region of the inlet opening.

2. A filter arrangement for removal of soot particles from the exhaust gases of an internal combustion engine, comprising:

a filter body comprising a porous filter material and having a plurality of filter ducts arranged in a honeycomb pattern, each filter duct having an inlet opening for the intake of the exhaust gases;

a resistance heating element arranged in a region of each inlet opening and having a series of loops, each loop having a flank and each loop projecting into a respective filter duct, said resistance heating element further having a lead-in line and a lead-out line connection to a current supply; and connecting means for form lockingly connecting a wall of a respective filter duct and a respective heating element loop together, said connecting means comprising a projection on each said flank and a corresponding recess receiving a respective projection on a respective filter duct.

3. A filter arrangement for removal of soot particles from the exhaust gases of an internal combustion engine, comprising:

a filter body comprising a porous filter material and having a plurality of filter ducts arranged in a honeycomb pattern, each filter duct having an inlet opening for the intake of the exhaust gases;

a resistance heating element arranged in a region of each inlet opening and having a series of loops, each loop projecting into a respective filter duct, said resistance heating element further having a lead-in line and a lead-out line connection to a current supply; and connecting means for form lockingly connecting a wall of a respective filter duct and a respective heating element loop together, said connecting means comprising a plurality of barbs attached to each loop for impeding an outward movement of said loop.

4. A filter arrangement as defined in claim 3, wherein said resistance heating element comprises a wire, said barbs being formed by a bend in said wire.

5. A filter arrangement for removal of soot particles from the exhaust gases of an internal combustion engine, comprising:

a filter body comprising a porous filter material and having a plurality of filter ducts arranged in a honeycomb pattern, each filter duct having an inlet opening for the intake of the exhaust gases;

a resistance heating element arranged in a region of each inlet opening and having a series of loops, each loop having projections and each loop projecting into a respective filter duct, said resistance heating element further having a lead-in line and a lead-out line connection to a current supply; and connecting means for form lockingly connecting a wall of a respective filter duct and a respective heating element loop together, said connecting means comprising heating means for heating said filter duct and said loops to a melting temperature of said porous material to fuse the projections with said porous material.

* * * * *